United States Patent [19]

Kantz

[11] Patent Number: 5,018,877

[45] Date of Patent: May 28, 1991

[54] PACKAGING ASSEMBLY FOR CONTAMINABLE MATERIALS

[75] Inventor: John F. Kantz, Oxford, N.J.

[73] Assignee: Union Carbide Chemicals and Plastics Technology Corporation, Danbury, Conn.

[21] Appl. No.: 484,781

[22] Filed: Feb. 26, 1990

[51] Int. Cl.[5] ..... B65D 30/04; B65D 33/36

[52] U.S. Cl. ..... 383/67; 383/61; 383/71; 383/113; 383/117; 383/906; 141/93; 141/114; 141/314; 222/105

[58] Field of Search ..... 383/61, 67, 71, 72, 383/113, 117, 906, 41; 141/93, 114, 314, 383; 222/105, 181, 185

[56] References Cited

U.S. PATENT DOCUMENTS

| | | | |
|---|---|---|---|
| 3,789,897 | 2/1974 | Saito | 383/67 X |
| 3,961,655 | 6/1976 | Nattrass et al. | 383/67 X |
| 4,113,146 | 9/1978 | Williamson | 383/41 X |
| 4,221,250 | 9/1980 | Manerba | 383/906 X |
| 4,296,860 | 10/1981 | Hsu et al. | 206/386 |
| 4,479,243 | 10/1984 | Derby et al. | 383/24 |

FOREIGN PATENT DOCUMENTS 3611188 10/1987 Fed. Rep. of Germany ..... 383/906

*Primary Examiner*—Stephen Marcus
*Assistant Examiner*—Jes F. Pascua
*Attorney, Agent, or Firm*—Clement J. Vicari

[57] ABSTRACT

A package assembly for providing ultra-clean storage and gravity discharge of contaminable powder or granular materials which comprises an outer container, a sterile vapor impermeable bag within said container, said bag having a bag body an inlet and an outlet, said inlet and outlet being closed when said bag accommodates said material to prevent contamination of said material, said outlet defining an opening, a flexible vapor impermeable tubular inner sheet extending from said opening and having a discharge end, a vapor impermeable tubular outer sheet enveloping said inner sheet terminating in a closed end, said inner sheet being secured by releasable securing means proximate said opening to prevent discharge of materials from said opening whereby when said inner sheet is positioned in a receiving means and said terminal end of said outer sheet is open and positioned around said receiving means and secured thereto, release of said securing means permits discharge of said material into said receiving means without contamination of said material.

2 Claims, 3 Drawing Sheets

PACKAGING ASSEMBLY FOR CONTAMINABLE MATERIALS

FIELD OF INVENTION

The present invention relates to a package assembly for providing ultra-clean storage and gravity discharge of contaminable powder or granular materials.

In another aspect the present invention relates to a sterile vapor impermeable bag which provides contamination free storage and gravity discharge of contaminable powder or granular material stored therein.

BACKGROUND OF THE INVENTION

Many products, such as powder or granular materials are shipped and stored in large bulk bags which can accommodate a heavy load in the order of thousands of pounds of materials.

For many operations the nature of the materials and their intended end uses make it imperative that these materials be "loaded" into these bags in a contamination free environment due to the fact that contaminants would negatively alter the desirable physical and chemical properties of the materials.

Thus materials such as powdery or granular resins which are used in the power cable industry are presently being loaded into bags in an ultra clean environment in order to provide the cleanliness needed for its insulating properties. As a matter of fact modern and sophisticated manufacturing of power cable resins is now accomplished in a closed system which greatly reduces contaminant levels over previous methods. However, in order to deliver this improved level of cleanliness to customers, it is necessary to extend the ultra-clean environment from the manufacturer to the extruder hopper of the converting operation. This can be accomplished by means of a manufacturer to converter sealed system. Unfortunately, however, until the present invention, no satisfactory system existed and product has been contaminated during storage and discharge resulting in unacceptable changes in the physical and chemical properties of the resins.

SUMMARY OF THE INVENTION

Broadly contemplated, the present invention provides a package assembly providing for storage and ultra-clean gravity discharge or transfer of contaminatable free flowing bulk materials such as powder or granular materials which comprises an outer container, a sterile vapor impermeable bag within said container, said bag having an inlet and an outlet said inlet and outlet being closed when said bag accommodates said material to prevent contamination of said material, said outlet defining an opening, a flexible vapor impermeable tubular inner sheet extending from said opening, and having a discharge end, a vapor impermeable tubular outer sheet enveloping said inner sheet terminating in a closed end, said inner sheet being secured by releasable securing means proximate said opening to prevent discharge of materials from said opening whereby when said inner sheet is positioned in a receiving means and said terminal end of said outer sheet is open and positioned around said receiving means and secured thereto by outer sheet closure means, release of said securing means permits discharge of said material into said receiving means without contamination of said material.

The package assembly can also include a woven outer liner enclosure completely surrounding and enclosing the bag to provide strength and increased portability to the bag.

In addition the composite i.e., the bag and the woven outer liner can be enclosed in a vapor impermeable sheet covering forming an outer cover lining which would further protect the material in the bag from contamination.

DESCRIPTION OF THE PREFERRED EMBODIMENTS

Figure 1:
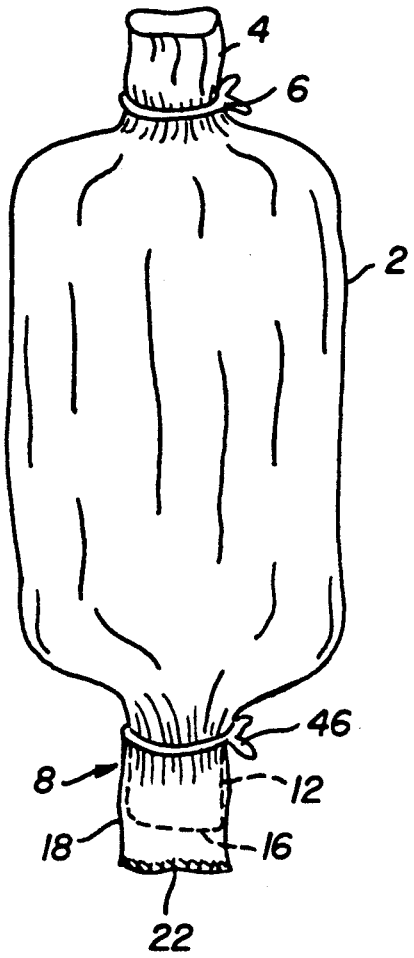
FIG. 1 is a front view of a bag showing the outlet with inner and outer sheets being extended away from the bottom of the bag.

Referring particularly to FIG. 1 there is illustrated a bag generally depicted by reference numeral 2 which can be fabricated from a material which is vapor impermeable and formed from a resin such as from high-pressure low density polyethylene, ethylene-vinyl acetate copolymers, medium or high density polyethylene, polypropylene, polybutene-1 and like thermoplastic flexible materials. The film from which the bag is fabricated is of sufficient thickness to prevent cracking or breaking depending on the materials contained therein. The bag is, if required, subjected to a sterilization treatment to remove or destroy undesired contaminants. The bag is provided with an inlet 4 at its top end which can be sealed to close the inlet or which can be opened or closed by tie string 6, and the bag is further provided with outlet 8 at its bottom end.

Figure 3:
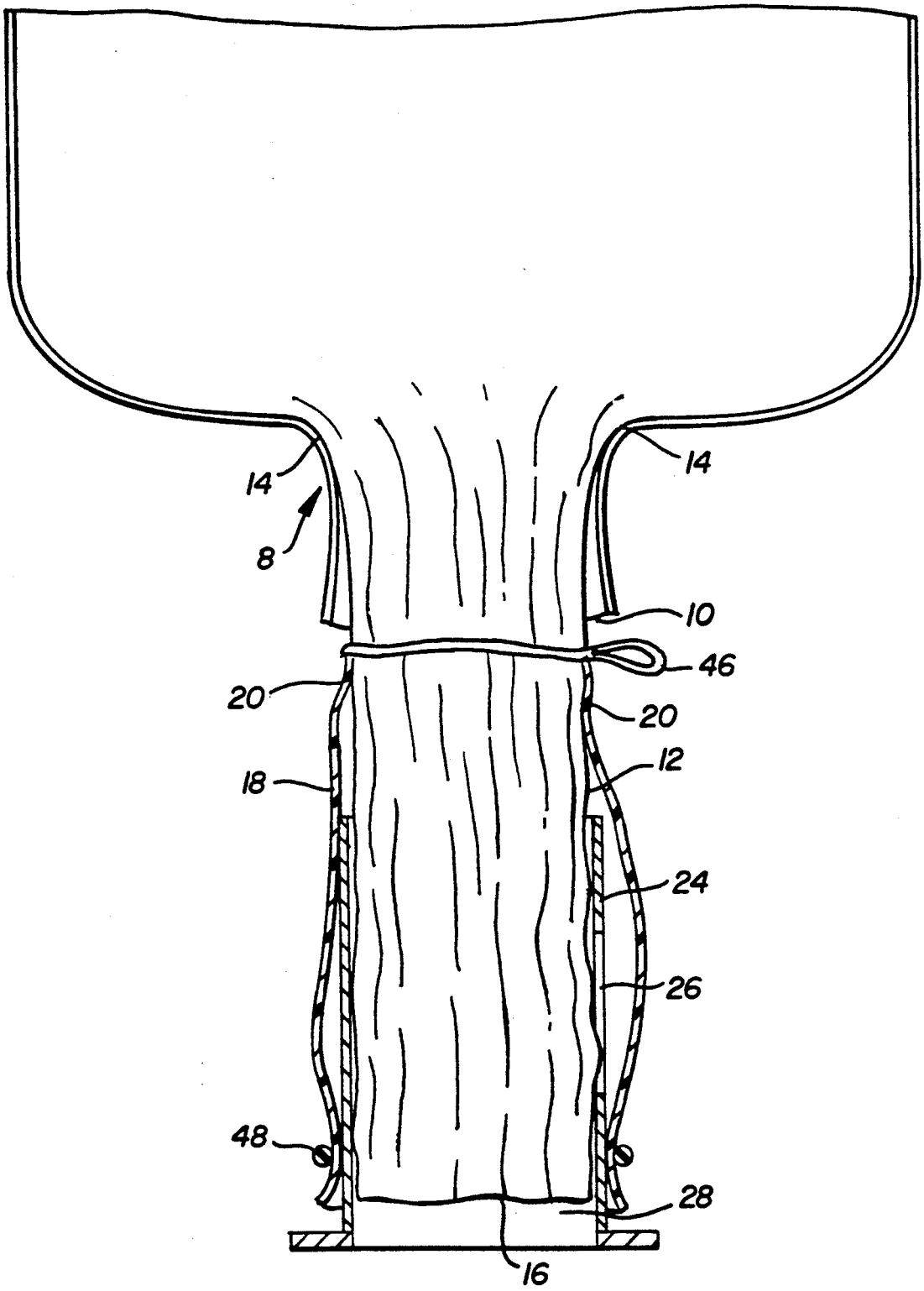
FIG. 3 is a view of the bottom portion of the bag in position over a material receiving means with the inner sheet inside the receiving means and the outer sheet in place around the receiving means.

As best seen in FIG. 3, outlet 8 defines an opening 10 and includes a flexible vapor impermeable tubular inner sheet 12 extending from opening 10 the upper end 14 of which is sealed to bag 2 in a manner such as to impart a closed configuration, preferably a tubular or circular configuration to inner sheet 12. Inner sheet 12 is adapted to be crumpled or furled due to its flexibility into opening 10 and can be constructed of the same material forming the bag body. Inner sheet 12 is also capable of being extended away from opening 10 to expose a discharge end 16 of inner sheet 12.

A vapor impermeable flexible outer sheet 18 is also provided which surrounds and envelopes inner sheet 12. Outer sheet 18 can also be fabricated from the same type of material as the bag body and the upper end 20 can be sealed to the inner sheet 12 proximate opening 10 as shown in the drawing or to the lower portion of the bag body. Outer sheet 18 is also adapted to be crumpled or furled into opening 10 and when extended and drawn from opening 10, the terminal sealed end 22 (as shown in FIG. 1) when opened preferably extends beyond discharge end 16 of inner sheet 12.

The bag can be utilized in combination with a receiving means which has a receiving inlet for loading discharged material into a hopper or like container and which can provide a contamination free loading. The inlet must provide access to inner sheet 12 from the interior of the receiving inlet prior to loading. An example of a receiving inlet is illustrated in FIG. 3 by reference numeral 24. The receiving inlet can be of rectangular or circular configuration preferably of the same configuration as outer sheet 18 and is constructed of materials which provide strength and rigidity to be able to support loading and unloading of material and to provide a proper base for securing outer sheet 18 to its periphery.

Receiving inlet 24 is provided with an opening 26 of sufficient dimension to permit an operator to insert a hand through to gain access to the interior 28 of receiving inlet 24.

Prior to unloading the contents of bag 2 into receiving inlet 24, inner sheet 12 and outer sheet 18 are furled into opening 10 of bag 2.

Figure 4:
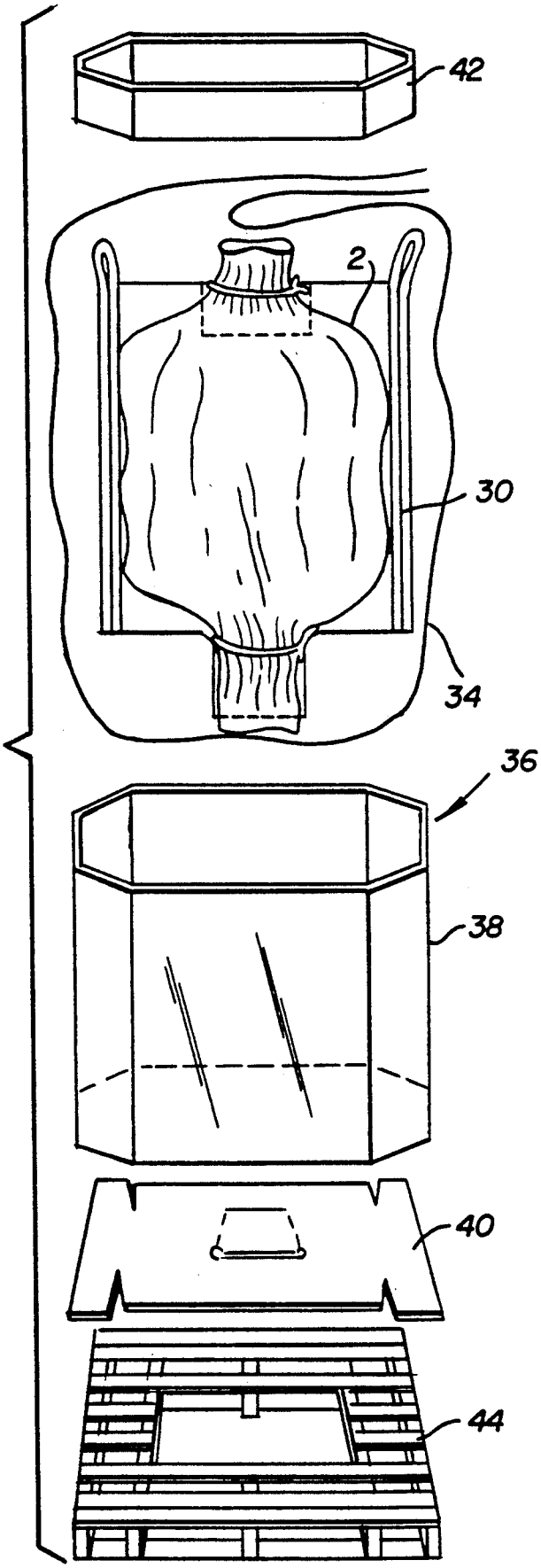
FIG. 4 is an exploded view with parts broken away and showing the composite assembly of the bag, woven outer liner, outer sheet covering and container.

The bag 2 can be shipped with a packaging assembly containing one or more of the outer coverings as shown in FIG. 4. Thus referring to FIG. 4, bag 2 can be enclosed in a woven outer liner depicted by reference numeral 30.

Figure 2:
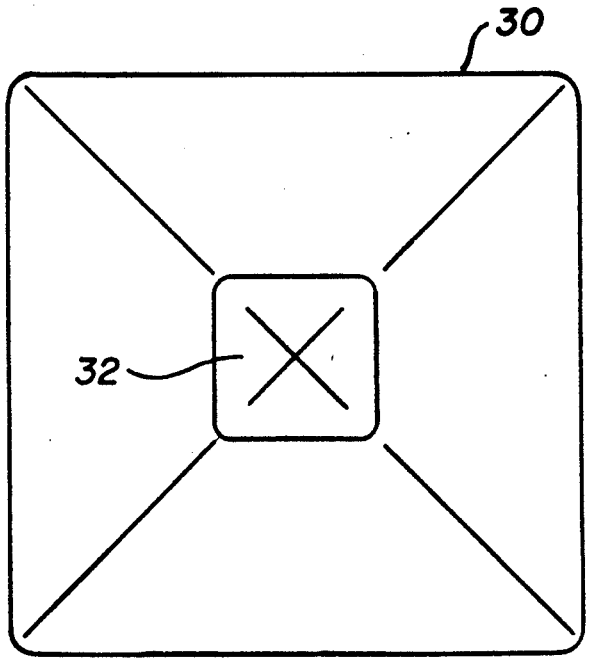
FIG. 2 is a view of the bottom of the outer liner and being provided with movable closure petals forming a part of the woven outer liner.

The outer liner can be formed from a woven fabric such as burlap, canvas, polypropylene, etc. The outer liner 30 can be rectangular in cross section and can be fabricated by techniques well known in the art. The bottom portion of the outer liner is provided with closure petals, 32 (as shown in FIG. 2) which when opened provide an opening substantially corresponding to opening 10 of bag 2.

Petals 32 can be triangular in cross section and when parallel to the bottom plane of the outer liner, they prevent the furled inner sheet 12 and outer sheet 18 from being dislodged from the bottom opening 10 of bag 2. Petals 32 are sufficiently flexible however so that when they are bent away from the bottom of the outer liner, they provide access to the inner sheet 12 and outer sheet 18 for extending the sheets in a direction away from opening 10.

If desired and to further insure against contamination of material during storage and shipment, the components, bag 2 and woven outer liner 30 can be completely enclosed in an outer sheet covering 34 which completely surrounds and contains woven outer liner 30 and bag 2. Outer sheet covering 34 is fabricated from a vapor impermeable material which can be similar to the materials forming bag 2.

The entire composite i.e, bag 2, woven outer liner in closure 30 and outer sheet covering 34 are contained in container 36 having a body portion 38, a bottom base plate 40, and a top cover 42. The container 36 is fabricated from heavy corrugated paperboard and the preferred container is of the type disclosed in U.S. Pat. No. 4,296,860 issued Oct. 27, 1989 and entitled Bulk Material Box.

The entire assembly can be transported and stored on pallet 44 until required for use.

In a typical mode of operation and use, the assembly arrives at the point of use with the entire contents of the stored material free from contamination. This is possible due to the material loading conditions and the sterilization of bag 2. At the point of use, outer sheet covering 34, woven outer liner 30, and bag 2 are separated from container 36. Outer sheet covering 34 can also be removed from woven outer liner 30 and bag 2. The remaining assembly can then be positioned over receiving inlet 24 leading to a sealed hopper for subsequent processing. Closure petals 32 are bent outward away from the bottom of woven outer liner 30 to provide access to furled inner sheet 12 and outer sheet 18. The operator then cuts terminal sealed end 22 of outer sheet 18 and places the end around the upper portion of receiving inlet 24, while leaving tie string 46 in its tightened position. The operator then inserts a hand through opening 26 and pulls down inner sheet 12 below opening 26 and into the interior of receiving inlet 24.

The operator then withdraws the hand and pulls outer sheet 18 downward around the periphery of receiving inlet 24 so that the severed end of the outer sheet 18 extends below opening 26. The bottom portion of outer sheet 18 is then secured around the periphery by an outer sheet closure means such as shock cord 48. After securing outer sheet 18, tie string 46 is loosened thereby permitting discharge of the contents of bag 2 into receiving inlet 24, such discharge being accomplished without exposing the contents to the contaminating materials which may be present in the atmosphere.

What is claimed is:

1. A package assembly for providing ultra-clean storage and gravity discharge of contaminatable powder or granular materials which comprises an outer container, a sterile vapor impermeable bag within said container, a woven outer liner completely surrounding and enclosing said bag and a vapor impermeable outer sheet covering enclosing said bag and said woven outer liner said bag having a bag body an inlet and an outlet, said inlet and outlet being closed when said bag accommodates said material to prevent contamination of said material, said outlet defining an opening, a flexible vapor impermeable tubular inner sheet extending from said opening and having a discharge end, a vapor impermeable tubular outer sheet enveloping said inner sheet terminating in a closed end, said inner sheet being secured by releasable securing means proximate said opening to prevent discharge of materials from said opening whereby when said inner sheet is positioned in a receiving means and said terminal end of said outer sheet is open and positioned around said receiving means and secured thereto, release of said securing means permits discharge of said material into said receiving means without contamination of said material.

2. A package assembly according to claim 1 wherein said woven outer liner includes a bottom portion having closure petals defining an access opening said closure petals being bent away from said bottom portion to provide an access opening substantially corresponding to said outlet opening.

* * * * *